United States Patent [19]

Potter

[11] Patent Number: 4,485,997

[45] Date of Patent: Dec. 4, 1984

[54] ROTATABLE BASE UNIT SUPPORT FOR A FILE CABINET

[76] Inventor: Frank Potter, 270 Adams Blvd., Farmingdale, N.Y. 11735

[21] Appl. No.: 534,271

[22] Filed: Sep. 21, 1983

[51] Int. Cl.[3] ..... A47B 49/00

[52] U.S. Cl. ..... 248/544; 248/349; 312/252; 211/163

[58] Field of Search ..... 248/349, 418, 425, 188.8, 248/544; 108/103, 104, 139; 211/70, 77, 78, 131, 163; 312/125, 135, 197, 202, 305, 252, 97.1

[56] References Cited

U.S. PATENT DOCUMENTS

| | | | |
|---|---|---|---|
| 327,032 | 9/1885 | Stevens | 108/139 |
| 559,161 | 4/1896 | Brower | 108/103 |
| 1,819,656 | 8/1931 | Pressley | 108/139 |
| 2,687,267 | 8/1954 | Copenhaver | 248/349 |
| 3,312,440 | 4/1967 | Zelony | 248/188.8 |
| 3,598,351 | 8/1971 | Schreyer | 248/188.8 |
| 3,692,266 | 9/1972 | Jacobs | 248/544 X |
| 3,868,157 | 2/1975 | Robinson | 312/305 |
| 4,191,437 | 3/1980 | Funke | 248/349 |

FOREIGN PATENT DOCUMENTS

| | | | |
|---|---|---|---|
| 838055 | 5/1952 | Fed. Rep. of Germany | 108/139 |
| 1429651 | 2/1969 | Fed. Rep. of Germany | 108/103 |
| 563215 | 11/1923 | France | 108/139 |
| 891733 | 12/1943 | France | 248/415 |
| 1214797 | 12/1970 | United Kingdom | 248/544 |

*Primary Examiner*—William H. Schultz
*Assistant Examiner*—Robert A. Olson
*Attorney, Agent, or Firm*—Nicholas J. Garofalo

[57] ABSTRACT

A file cabinet support in the form of a base unit having an upper member rotatable relative to a stationary lower member selectively in either direction so as to present to the user either an open or a walled side of a separable file cabinet mounted upon the upper member; a floating disk between the upper and lower members having rollers about its periphery which ride against opposed flat surfaces of the upper and lower members; a pair of parallel heavy metal rings, one fixed to and encased in the upper member, the other fixed to an underface of the lower member, the rings having the sides of their rims in alignment with the peripheries of the rollers; a pivot shaft unitary with the upper member depending axially through the unit to the underside of the lower member; and a plate washer bolted to a bottom end of the pivot shaft restraining separation of the components of the unit.

2 Claims, 5 Drawing Figures

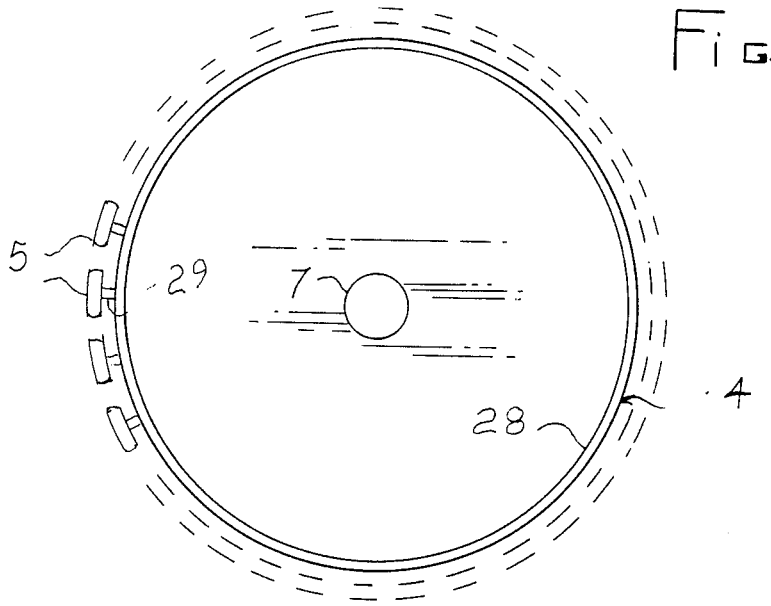
Fig. 3
Fig. 4
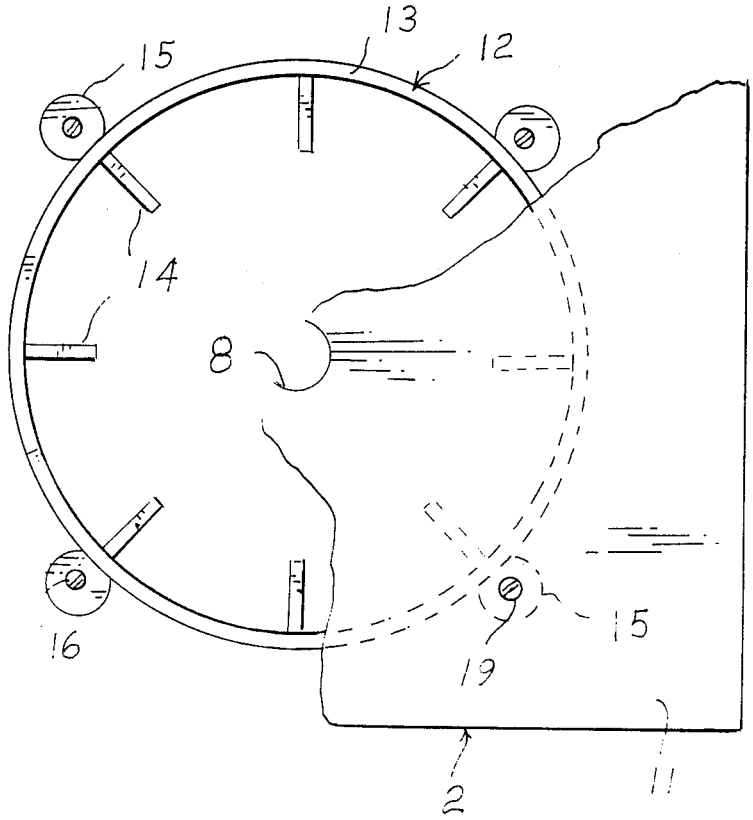

ROTATABLE BASE UNIT SUPPORT FOR A FILE CABINET

BACKGROUND OF THE INVENTION

This invention is directed, in general, to filing apparatus having a file cabinet mounted for rotation relative to a stationary base so as to enable selective presentation, according to the degree of rotation, of open or walled sides of the cabinet to the user. More particularly, it is directed to providing an improved rotatable base unit for such apparatus.

Conventional filing apparatus of this general nature is known wherein the bottom of the cabinet and a separate opposed stationary base define between them an annular raceway loaded with ball bearings, the separate parts of the raceway being held in bearing relation to the balls by means of a bolt defining the axis of rotation. An undesirable aspect of such an arrangement is a tendency of dirt to accumulate in the lower part of the raceway. This may cause sluggish movement of the ball bearings so as to impede smooth turning of the heavily loaded cabinet. The time and labor required to empty and dismantle such cabinets to clean the clogged condition may cause cleaning to be neglected until the apparatus is rotatably jammed or the raceway has broken down.

Further, in apparatus where the bottom of the cabinet is an integral part of the raceway or rotation mechanism, the apparatus cannot be readily interchanged with cabinets not having a raceway in their bottom ends.

A further disadvantage of filing apparatus employing ball bearing raceways is that the load of the cabinet on the ball bearings and raceway walls may cause undesirable wear pockets to develop, particularly when grit or the like finds its way into the raceway. Further, because of a lack of a solid under-support to the ball raceway in such apparatus, problems of flexing and wobble may arise, particularly with heavily loaded tall cabinets, so as to require pivot support of the cabinet not only at its base but also at the upper end of the cabinet.

SUMMARY OF THE INVENTION

The present invention provides a rotatable base unit which avoids the undesirable deficiencies and consequent disadvantages associated with conventional filing apparatus.

In accordance with the invention there is provided a rotatable base unit which is independent of the cabinet to be mounted thereon. It comprises: a stationary lower base member, an upper base member rotatable relative to the lower base member and adapted to have mounted thereon a separable file cabinet, a floating disk disposed between opposed flat surfaces of the upper and lower base members is spaced relation to both, a succession of closely spaced rollers mounted on stub axles projecting from a peripheral wall of the disk, the rollers being in peripheral rolling contact with the opposed surfaces of the upper and lower base members, a pivot shaft fixed to the upper base member depending axially from the latter through pivot holes in the disk and lower base member, and a plate washer bolted to a bottom end of the pivot shaft below the underface of the lower base member.

A particular advantage of the roller feature is that the rollers ride on opposed flat surfaces. Accordingly, there are no raceway pockets to accumulate dirt to impede operation of the rollers.

Another advantage and feature of the present invention is that the rotatable base unit is not an integral part of the cabinet to be mounted thereon. The cabinet is separable from the base unit, and it can be readily removed therefrom without affecting the independent rotatable capacity of the base unit. This feature enables the base unit to be employed as a rotatable support for cabinets of various forms and sizes.

A feature of particular advantage lies in a pair of heavy metal support rings, one of which is encased between an upper plate and a lower covering plate of the upper base member; and the other of which is fixed to the underface of a top plate of the lower base member. The rings are parallel and axially aligned with each other and with the disk. The overall diameter of the disk with its rollers corresponds to that of the rings. In this arrangement, the peripheries of the rollers are aligned with correspondingly broad sides of the rims of the opposed rings, whereby a solid support is provided for the load of a cabinet mounted on the base unit.

The several advantages and features of the present invention provide a rotatable base unit of strength and balance, one which can support for rotation, without flexing or imbalance, tall heavily loaded conventional as well as various other file cabinets. To this end, it does not require any added pivot support at the top end of a cabinet to be mounted thereon.

The foregoing structure, features and advantages of the invention will become increasingly apparent as this specification unfolds in greater detail, and as it is read in conjunction with the accompanying drawing wherein an embodiment of the invention is shown. However, it is to be expressly understood that the drawing is for purposes of illustration; and it is not to be construed as limiting the scope of the invention.

BRIEF DESCRIPTION OF THE DRAWING

In the accompanying drawing:

FIG. 3 is a bottom plan view of the disk member;

FIG. 4 is a top plan view of the ring, together with a portion of the table top plate of the lower base member.

DESCRIPTION OF PREFERRED EMBODIMENT

Figure 1:
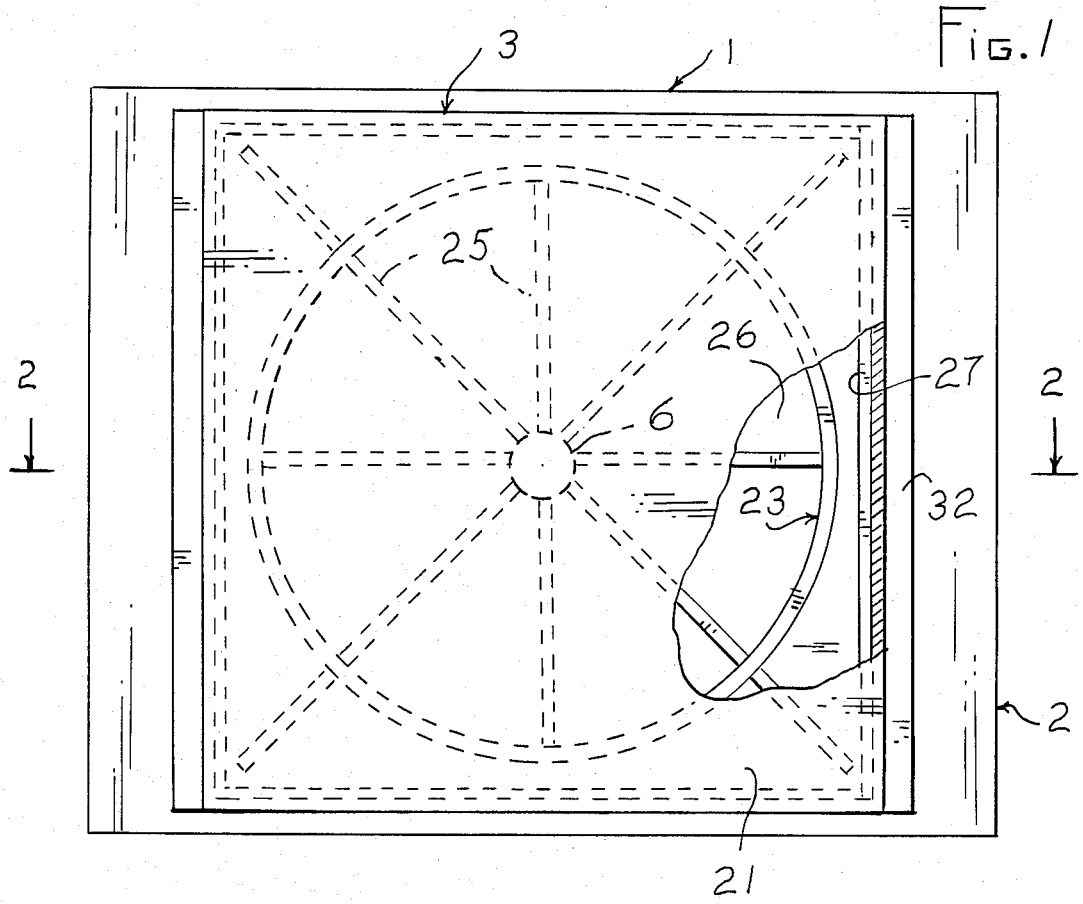
FIG. 1 is a top plan view of a rotatable base unit embodying the invention.

The invention will now be described with reference to the accompanying drawing sufficiently and in such concise manner as to enable persons having ordinary skill in the art to understand and use the invention.

The rotatable base unit shown in the drawing as illustrating an embodiment of the invention is indicated, generally, by the numeral 1. It includes a lower base member 2 adapted to rest in a stationary condition upon a floor surface; an upper base member 3 rotatable about a verticle axis relative to the lower base member; a floating disk 4 disposed between the upper and lower base members retaining about its periphery a succession of ball bearing rollers 5, the peripheral surfaces of the rollers being in rolling contact with opposed faces of the upper and lower base members; a verticle pivot shaft 6 depending axially from the upper base member through pivot holes 7, 8 formed axially of the floating disk and the lower base member, whereby the upper base member is rotatable over the rollers relative to the lower base member; and a plate washer 9 bolted to a bottom end of the pivot shaft below an underface of the lower base member retaining the several described components together as the base unit 1.

In use, the lower base member 2 has a stationary condition on a floor surface. It has a rectangular flat table top 11 of sheet metal. It is given strength and rigidity by the underlying support of a steel ring 12 having a broad thick peripheral wall or rim 13. The ring is fixed, as by tack weld, in abutting relation to the underface of the table top 11 in coaxial relation to the latter. Integral with the ring are radially extending braces 14, which abut the underface of the table top so as to provide increased rigidity and support for the latter.

The braces are spaced equally about the ring. Enlargements, here four in number, integral with the periphery of the ring define leg sockets 15 spaced ninety degrees apart. Threaded into each socket is a leg bolt 16 terminating in an external floor engageable foot pad 17. The leg bolts are adjustable in the sockets to bring the base member 2 to a level condition on a floor surface 18. Small holes 19 in the table top 11 coinciding with open upper ends of the leg sockets allow access of a screwdriver to slotted ends of the leg bolts for purposes of adjustment. The number of leg sockets and leg bolts may be varied, as desired. Ring 12 is axially centered relative to the table top.

The rotatable upper base member 3 includes a sheet metal flat top 21, preferably of square form, having depending side walls 22 about its perimeter. Fixed, as by tack weld, in abutting relation to the undersurface of the flat top 21 is a steel ring 23 having a broad thick peripheral wall or rim 24. The ring is axially centered relative to the flat top. The pivot shaft 6, defining the hub of the ring, is integral with the ring and depends axially therefrom.

Ring 23, together with its pivot shaft is strengthened by means of a plurality of radial spokes or ribs 25, spaced equally from one another. Each rib is fixed or integral at its outer end to the inner face of the rim 24, and is fixed or integral at its inner end with the hub or pivot shaft 6. The side walls of the several ribs correspond in vertical depth to that of the rim 24.

A sheet metal cover 26 is disposed in abutting underlying relation to the bottom surfaces of ring 23 and its ribs. It is of square configuration. It has four upstanding side walls or flanges 27, and it has a centered pivot hole through which the pivot shaft 6 depends. In its assembled condition, the cover seats against the bottom surfaces of the ring and its ribs, and its side walls 27 extend upwardly adjacent the inner faces of the depending side walls 22 of the top plate 21.

The floating roller retaining disk 4 has a peripheral wall or flange 28. The rollers 5 are bearing mounted on stub axles 29, which are fixed to and extend radially from flange 28 at the midline of the latter. The rollers have a diameter greater than the vertical height of the flange. They are in rolling contact with the upper face of the lower base member 2, and are in rolling contact with the underface of the bottom cover 26 of the upper base member 3. Due to the greater diameter of the rollers relative to the peripheral flange 28 of the disk, the latter together with its flange is spaced clear of the opposed surfaces of the upper and lower base members. This gives to the disk a floating characteristic, relieved and free of load.

It is to be noted that the ring elements 23, 12 of the upper and lower base members are of equal diameter, and that the overall diameter of the disk 4 together with its rollers 5 corresponds to that of the ring elements. This is a desirable and advantageous feature of the base unit. By means of this arrangement, the cabinet load carried by the rotatable upper base member 3 is supported by the aligned relationship of the upper ring 23, the rollers 5 and the lower ring 12. In effect, the several aligned elements, one below the other, provide a solid supporting wall to the load. A further advantage of this arrangement is that the axles of the rollers are virtually free of load, so that there is little liklihood of their breaking or deforming relative to the retaining disk 4.

Figure 2:
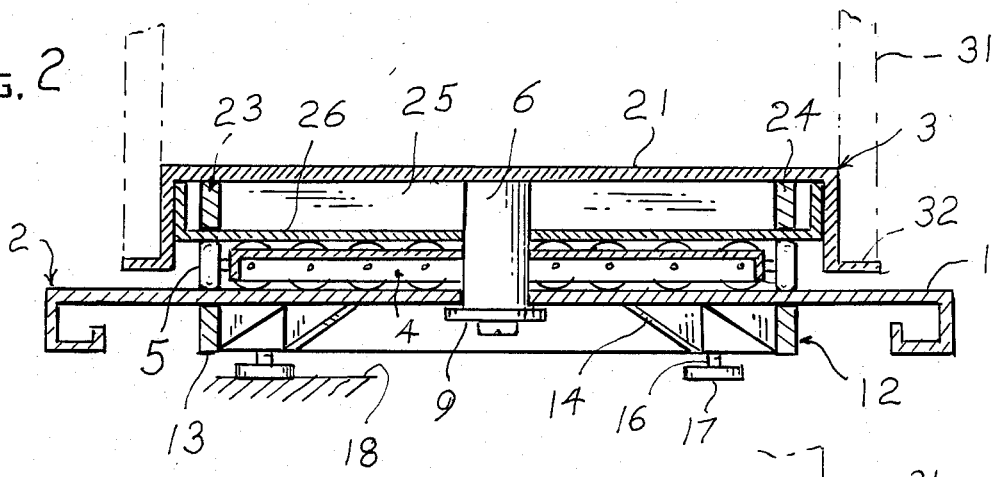
FIG. 2 is a cross section on line 2—2 of FIG. 1.

The rotatable upper base member 3 is provided with suitable means whereby file cabinets of various sizes may be attached to it. One form of this means is illustrated in FIG. 2 by the depending sides 22 of the top plate 21. With this form, a file cabinet having opposed open sides and opposed walled sides can be readily mounted in place by seating the bottom ends of its walled sides 31 on the flanged portions 32 of sides 22 and fixing them in place by fasteners or tack weld.

Figure 5:
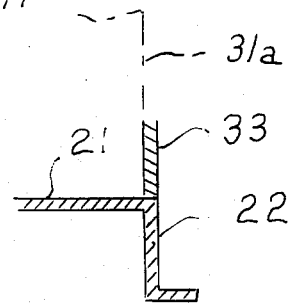
FIG. 5 is a detail view illustrating a further means for mounting a file cabinet upon the base unit.

In another form, the cabinet attaching means may be provided by brackets or upstanding lips 33 fixed upon opposite areas of the top of the upper base member, as in FIG. 5. The brackets may be located where needed in accordance with the dimensions of the cabinet to be mounted on the base unit. The cabinet would then be seated upon the top plate of the upper base member, and its side walls would then be secured to the brackets.

While an embodiment of the invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such form and modifications or equivalents thereof as might be construed to be within the spirit of the invention, when considered in the light of the specification, the drawing and the appended claims.

I claim:

1. A rotatable base unit for a file cabinet, comprising an upper base member having a top plate adapted to have a file cabinet mounted thereon, a spoked first ring element fixed to an underface of the top plate having a hub defining an axially depending pivot shaft, and a plate cover seated against the underside of the first ring element having at its center a pivot hole through which the pivot shaft depends; a lower base member adapted to have a stationary condition upon a floor surface, and having a table top plate and a second ring element fixed to an underface of the table top plate; a disk disposed parallel to and with clearance between the plate cover and the table top plate; a succession of closely spaced rollers mounted on stub axles projecting radially from the periphery of the disk, the rollers having their peripheries in rolling contact with the opposed plate cover and the table top plate; the first and second ring elements being of the same diameter and in parallel relationship; each ring element having a rim of a radial thickness corresponding to the width of the peripheries of the rollers and aligned with the said peripheries; the disk and the table top plate having center pivot holes through which the pivot shaft depends; and a washer element secured to the pivot shaft below the table top plate.

2. A base unit providing a rotatable support for a file cabinet, the unit comprising: a lower member having a table top plate, a bracing ring fixed in abutment with an underface of the table top plate, the bracing ring having leg sockets boss elements about its periphery, floor engageable leg bolts threadedly engaged in the leg sockets and depending therefrom, the leg bolts having screw driver slots in their upper ends accessible through openings in the table top plate for adjusting the leg bolts relative to the leg sockets so as to obtain a level condition of the lower member; an upper member having a sheet plate top upon which a file cabinet is adapted to be mounted, a strengthening ring fixed in abutment with an underface of the sheet plate top having spoked ribs fixed at their inner ends to an axially depending pivot shaft, and a sheet plate cover abutting undersurfaces of the strengthening ring and the spoked ribs, the sheet plate cover having an axial hole through which the pivot shaft depends; a floating disk disposed with clearance between and in parallel relation to the sheet plate cover and the table top plate, a succession of closely spaced rollers mounted about the periphery of the disk having rolling contact with the sheet plate cover and the table top plate, the rollers being mounted upon stub axles projecting radially from a peripheral flange of the disk, and the stub axles spacing the rollers radially from and in close proximity to the flange; the pivot shaft depending through axial holes in the disk and in the table top plate allowing rotation of the upper member over the rollers relative to the lower member; a plate washer fixed to a bottom end face of the pivot shaft and projecting radially below an undersurface of the table top plate; and the bracing and strengthening rings having peripheral rims of a radial width corresponding to the radial width of the peripheries of the rollers and aligned therewith.

* * * * *